US008899786B1

(12) United States Patent
Moghal et al.

(10) Patent No.: US 8,899,786 B1
(45) Date of Patent: Dec. 2, 2014

(54) METHOD AND APPARATUS FOR LIGHT SQUARE ASSEMBLY

(75) Inventors: Khurram Zeshan Moghal, Senoia, GA (US); Philip Dean Winters, Senoia, GA (US); Sridhar Reddy Nimma, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 124 days.

(21) Appl. No.: 13/464,077

(22) Filed: May 4, 2012

(51) Int. Cl.
*F21V 5/00* (2006.01)

(52) U.S. Cl.
USPC ..... 362/244; 362/249.02

(58) Field of Classification Search
USPC ..... 362/158, 235–237, 240, 244, 249.01, 362/249.02, 267, 311.14, 374, 517, 520, 362/521, 522, 544–546, 800, 812
See application file for complete search history.

(56) References Cited

U.S. PATENT DOCUMENTS

| | | | | |
|---|---|---|---|---|
| 4,104,711 | A * | 8/1978 | Carter | 362/153 |
| 4,254,453 | A * | 3/1981 | Mouyard et al. | 362/240 |
| 5,249,104 | A * | 9/1993 | Mizobe | 362/605 |
| 6,557,283 | B1 * | 5/2003 | Canfield | 40/564 |
| 7,736,019 | B2 * | 6/2010 | Shimada et al. | 362/244 |
| 7,950,821 | B1 * | 5/2011 | Georgitsis et al. | 362/217.12 |
| 7,976,194 | B2 * | 7/2011 | Wilcox et al. | 362/268 |
| 8,358,081 | B2 * | 1/2013 | Panagotacos et al. | 315/224 |
| 2005/0231949 | A1 * | 10/2005 | Kim et al. | 362/249 |
| 2007/0216172 | A1 * | 9/2007 | Chang | 292/336 |
| 2009/0298376 | A1 * | 12/2009 | Guillien et al. | 445/43 |
| 2011/0235313 | A1 * | 9/2011 | Canella | 362/157 |
| 2012/0218773 | A1 * | 8/2012 | Peiler et al. | 362/520 |
| 2013/0044478 | A1 * | 2/2013 | Steedly | 362/235 |
| 2013/0235583 | A1 * | 9/2013 | Chang et al. | 362/249.02 |

FOREIGN PATENT DOCUMENTS

WO WO 2008138177 A1 * 11/2008

* cited by examiner

*Primary Examiner* — Hargobind S Sawhney
(74) *Attorney, Agent, or Firm* — King & Spalding LLP

(57) ABSTRACT

A light module includes a cover, a circuit board, a gasket, a bottom covering, and an optional optic assembly. The cover includes an inner and an outer wall extending outwardly from the cover, where the outer wall surrounds the inner wall and forms a groove therebetween. The circuit board is positioned within the inner wall's profile and includes a plurality of LEDs. The gasket is disposed within the groove. The bottom covering is positioned adjacent to the circuit board and is coupled to the cover. The gasket provides a seal between the cover and the bottom covering. The optic assembly is disposed within the inner wall's profile and between the cover and the circuit board. The optic assembly includes one or more apertures and one or more optics disposed around at least some of the apertures. Each optic is aligned with one or more LEDs.

20 Claims, 9 Drawing Sheets

METHOD AND APPARATUS FOR LIGHT SQUARE ASSEMBLY

TECHNICAL FIELD

Exemplary embodiments of the present disclosure relate generally to lighting solutions, and more particularly to systems, methods, and devices for providing a light emitting diode ("LED") light module that includes a sealed LED board and provides flexibility in its use.

BACKGROUND

There are many advantages to the use of light emitting diode (LED) die packages as light sources in light fixtures to produce light efficiently. Many light fixtures have incorporated one or more arrays of LED light modules, each of which includes one or more LED arrays, to emit the desired lumen output and shape of the light output. Some of these light fixtures are used in applications for street lighting, pathway lighting, parking structure lighting, decorative lighting, and any other type of spread beam applications.

Typically, the LED arrays are made up of LED die packages that each include an LED light source with a lens (or primary optic), where each of the LED die packages are in turn associated with an optical system (or secondary optic) to control and/or maximize the light emitted from the LED die package. In other configurations, the LED light source may only have one over-optic to refract light. Each of the secondary optics aligned with the LED light source may be varied in shape and/or individually rotated to create a beam pattern for the array that is unique from the devices themselves, including all degrees of freedom, e.g. separately determined translation, tilt, and yaw for each lens. The array may include similarly colored LEDs, white or otherwise, or various colored LEDs.

The LED die packages are typically coupled to a front surface of a printed circuit board which electrically couples the LED die packages to a power source. The printed circuit board may further include circuitry to drive the LED die packages, or LEDs, included in one or more arrays of LED light sources. In the lighting applications mentioned above, the light fixtures typically include a heat sink that is coupled directly to a rear surface of the printed circuit board. Typically, the printed circuit board is coupled to a surface of the heat sink by inserting screws, or other fastening devices, through one or more holes formed within the printed circuit board and into one or more corresponding openings formed within the heat sink. The heat sink is typically made of heat conductive aluminum alloy and may provide heat dissipation to allow proper cooling of the LEDs. Alternatively, the heat sink is fabricated using other thermally conductive materials.

These heat sinks are generally exposed to the surrounding environment and may allow water, from rain, to enter into the circuitry area of the printed circuit board from the heat sink and the rear surface of the printed circuit board. Specifically, water may enter through the holes formed within the printed circuit board and/or through the sides portions of the printed circuit board. If the water is acidic, the water entering into the circuitry area of the printed circuit board can cause the printed circuit board to fail, thereby causing expenses, in material and labor, to fix the light fixture and inconvenience to passersby for a time period when light is no longer emitted from the failed LED light module.

SUMMARY

One exemplary embodiment of the invention includes a light module. The light module can include a cover plate, a circuit board, a gasket material, and a bottom covering. The cover plate can include a first surface, an opposing second surface, an inner wall extending orthogonally out from the second surface, and an outer wall extending orthogonally out from the second surface. The inner and outer walls can define a groove formed therebetween. The outer wall can be surrounding the inner wall. The circuit board can include a plurality of light emitting diodes ("LEDs") coupled thereon. The circuit board can be disposed within the profile of the inner wall. The LEDs can be oriented to emit light towards the cover plate. The gasket material can be disposed within the groove. The bottom covering can be disposed adjacent to the circuit board and coupled to the cover plate. The gasket material can provide a seal between the cover plate and the bottom covering.

Another exemplary embodiment of the invention includes a light module. The light module can include a cover plate, an optic assembly, a circuit board, a gasket material, and a bottom covering. The cover plate can include a first surface, a second opposing surface, a channel disposed in the second surface, and at least one first opening extending through the cover plate. The channel can include an inner wall. The optic assembly can be disposed within the profile of the inner wall. The optic assembly can include one or more second openings formed therethrough and at least one lens coupled to the optic assembly. Each lens can be disposed over at least one of the second openings and extend through at least a portion of the respective first opening. The circuit board can include a plurality of light emitting diodes ("LEDs") coupled thereon. The circuit board can be disposed within the profile of the inner wall and adjacent to the optic assembly. The LEDs can be oriented to emit light into the respective lens. The gasket material can be disposed within the groove. The bottom covering can be disposed adjacent to the circuit board and coupled to the cover plate through apertures disposed outside of a perimeter of the channel. The gasket material can provide an environmental seal between the cover plate and the bottom covering.

Another exemplary embodiment of the invention includes a method for assembling a light module. The method can include providing a cover plate, placing an optic assembly within a profile of an inner wall of the cover plate, placing a circuit board adjacent to the optic assembly and within the profile of the inner wall, placing a gasket material within a groove formed in the cover plate, positioning a bottom covering adjacent the circuit board, and coupling the bottom covering to the cover plate. The cover plate can include a first surface, an opposing second surface, the inner wall extending orthogonally out from the second surface, an outer wall extending orthogonally out from the second surface, and one or more first openings extending from the first surface to the second surface. The inner and outer walls can define the groove that can be formed therebetween. The outer wall can be surrounding the inner wall. The optic assembly can include a top surface, a bottom surface, one or more second openings extending from the top surface to the bottom surface, and at least one lens coupled to the top surface. Each lens can be disposed over one or more of the second openings. At least a portion of each lens can be inserted through at least a portion of the respective first opening. The circuit board can include a plurality of light emitting diodes ("LEDs") coupled thereon. The LEDs can be oriented to emit light into the respective lens. The gasket material can provide an environmental seal between the cover plate and the bottom covering.

Another exemplary embodiment of the invention includes a light module. The light module can include a cover plate, a bottom covering, a circuit board, and a plurality of fastening devices. The cover plate can include a plurality of light emitting diode (LED) apertures and a first plurality of coupling apertures. The bottom covering can include a second plurality of coupling apertures. The circuit board can include a surface defined by an outer perimeter and a plurality of LEDs coupled to the surface. The circuit board can be disposed between the cover plate and the bottom covering and within the profile of the cover plate. Each fastening device can extend at least partially through one of the first plurality of coupling apertures and one of the second plurality of coupling apertures to couple the bottom covering to the cover plate. Each fastening device can extend through the cover plate to the bottom covering at a position outside of the outer perimeter of the circuit board. The LEDs can emit light through the LED apertures.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
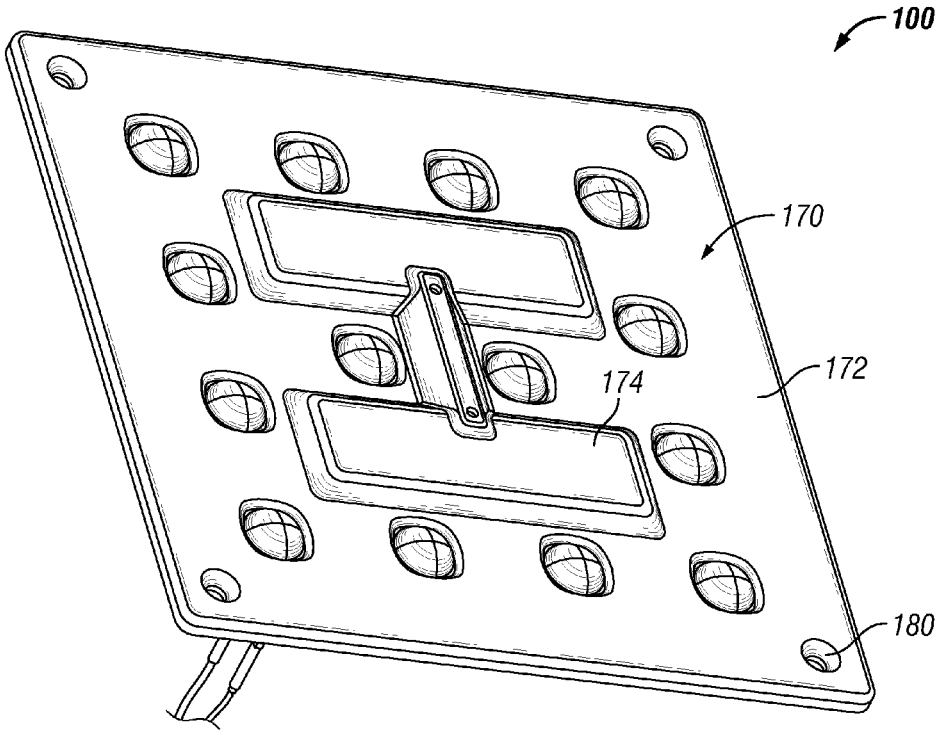
FIG. 1 is a perspective view of a light emitting diode (LED) light module in accordance with an exemplary embodiment of the present invention.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present disclosure is directed to systems, methods, and devices for providing a light emitting diode ("LED") light module that includes a sealed LED board and provides flexibility in its use. The disclosure is better understood by reading the following description of non-limiting, exemplary embodiments with reference to the attached drawings, wherein like, but not necessarily the same or identical, parts of each of the figures are identified by like reference characters, and which are briefly described as follows.

Figure 2A:
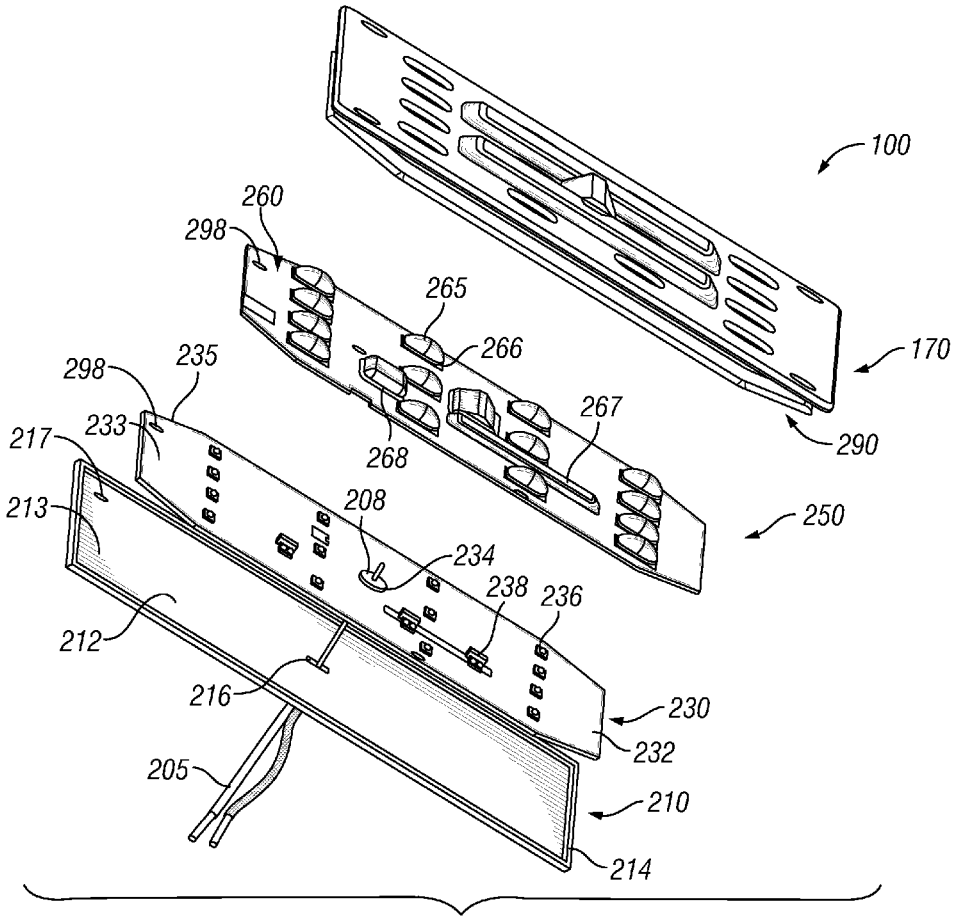
FIG. 2A is an exploded view of the LED light module of FIG. 1 in accordance with an exemplary embodiment of the present invention.
Figure 2B:
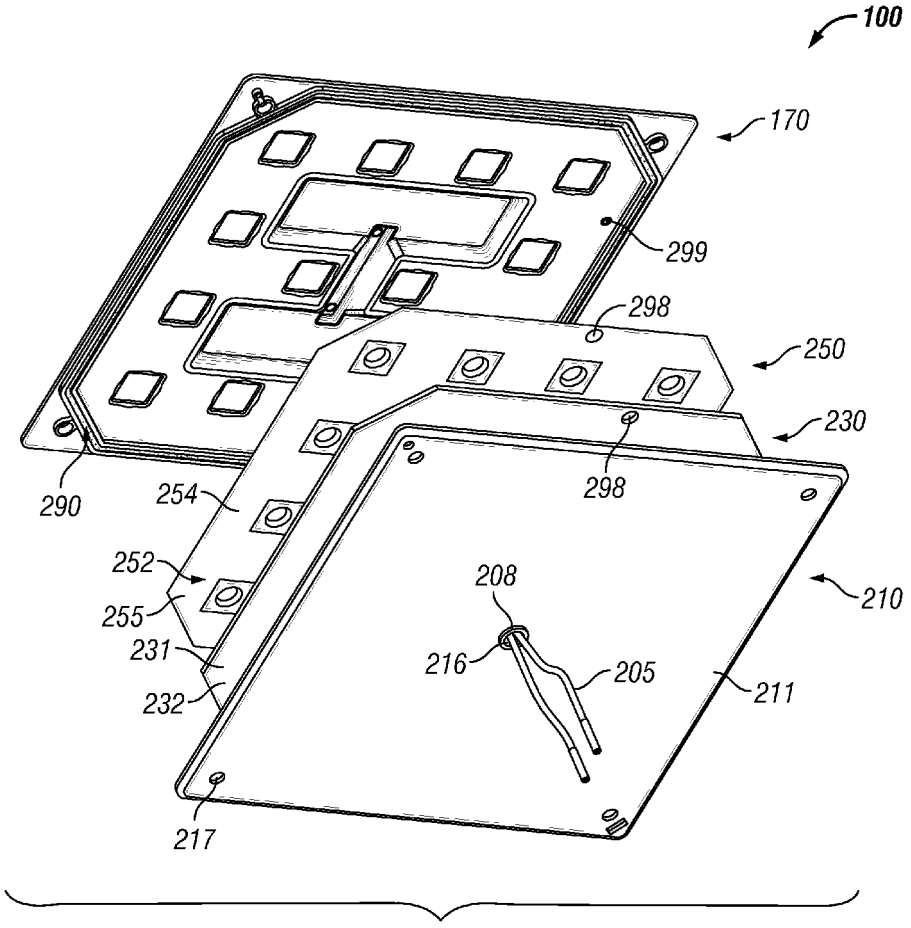
FIG. 2B is another exploded view of the LED light module of FIG. 1 in accordance with an exemplary embodiment of the present invention.

FIG. 1 is a perspective view of a light emitting diode (LED) light module 100 in accordance with an exemplary embodiment of the present invention. FIG. 2A is an exploded view of the LED light module 100 in accordance with an exemplary embodiment of the present invention. FIG. 2B is another exploded view of the LED light module 100 in accordance with an exemplary embodiment of the present invention. Referring to FIGS. 1-2B, the LED light module 100 includes a rain shield plate 210, a LED board 230, an optic assembly 250, a cover plate 170, and a gasket 290.

The rain shield plate 210, or bottom covering, is square shape and includes a base plate 212 having an inside surface 213 and an outside surface 211 which is facing an opposite direction than the inside surface 213. Although the rain shield plate 210 is square shaped, the rain shield plate 210 is a different shape in other exemplary embodiments, such as circular, triangular, or any other geometric or non-geometric shape. In certain exemplary embodiments, the rain shield plate 210 is shaped in a manner such that the rain shield plate 210 is rotatable a desired angle and has the same shape as before its rotation. For example, if the rain shield plate 210 is triangular shape, i.e. an equilateral triangle, the rain shield plate 210 is rotatable every 120 degrees and has the same shape as before its rotation. According to some exemplary embodiments, the rain shield plate 210 also includes a sidewall 214 extending orthogonally from the perimeter of the base plate 212. The rain shield plate 210 is fabricated using aluminum, but other suitable thermally conductive materials, such as other metals, and metal alloys, are used in alternative exemplary embodiments. According to some exemplary embodiments, the outside surface 211 of the rain shield plate 210 is coupled to and in thermal contact with a heat sink (not shown). In other exemplary embodiment, the rain shield plate 210, or bottom covering, is the heat sink. In these exemplary embodiments, the rain shield plate 210 transfers at least a portion of the heat generated from the LEDs 236, or LED die packages, from the LED board 230 to the heat sink.

The base plate 212 includes an opening 216 and one or more apertures 217 formed therein. The opening 216 is formed substantially in the center portion of the base plate 212 and is dimensioned to allow one or more electrical wires 205 to be inserted therein. However, in other exemplary embodiments, the opening 216 is formed in a different portion of the base plate 212. The electrical wires 205 provide electrical current to the LEDs 236, or LED die packages, on the LED board 230, which is discussed in further detail below. In certain exemplary embodiments, at least a portion of a compression grommet 208 is inserted into the opening 216 and surrounds the electrical wires 205, thereby sealing the opening 216 and preventing water or other hazards from entering the LED light module 100 through the opening 216. The compression grommet 208 squeezes the electrical wires 205 once the electrical wires 205 are inserted through the opening 216. The compression grommet 208 is fabricated using a polymer, such a rubber, but other suitable sealing materials are used in alternative exemplary embodiments. The apertures 217 is formed about the perimeter of the base plate 212 and is dimensioned to allow at least a portion of a fastening device (not shown), such as a screw, to be inserted therein and thereby facilitate the coupling of the rain shield plate 210 to the cover plate 170. According to some exemplary embodiments, each aperture 217 is formed at each corresponding corner of the base plate 212.

The LED board 230 includes a substrate 232 and one or more LED or LED die package 236 mounted thereon. According to some exemplary embodiments, the LED board 230 also includes electrical components, such as a driver 238, mounted onto the substrate 232. According to some exemplary embodiments, the substrate 232, hereinafter referred to as a printed circuit board or PC board, includes one or more sheets of ceramic, metal, laminate, circuit board, Mylar®, or another material. The PC board 232 also includes a first surface 233, a second surface 231, and an opening 234 for receiving at least an end of the electrical wires 205. The first surface 233 is facing a direction opposite of the direction that the second surface 231 is facing. The second surface 233 is oriented to face the rain shield plate 210 once the LED light module 100 is assembled. According to some exemplary embodiments, the opening 234 lies axially and centrally along the length of the PC board 232; however, this opening can lie in a different location in other exemplary embodiments. The opening 234 is axially aligned with the opening 216 of the rain shield plate 210 once the LED board 230 is disposed onto the rain shield plate 210 and the LED light module 100 is assembled. A portion of the compression grommet 208 is inserted within the opening 234 and compresses the electrical wires 205 once inserted through the opening 234. The PC board 232 is substantially square shaped and includes one or more chamfered corners 235. However, the PC board 232 is shaped different in alternative exemplary embodiments. According to some exemplary embodiments, each corner of the PC board 232 is a chamfered corner 235 which thereby exposes the apertures 217 within the base plate 212 from the inside surface 213 when the LED board 230 is disposed on the rain shield plate's inside surface 213. The PC board 232 provides a convenient means to provide power to the LEDs 236 and are known to people having ordinary skill in the art. However, other means for conveying power to the LEDs 236 also are contemplated herein, for example, connectors, sockets, plugs, direct wiring, and other means known to people having ordinary skill in the art.

One or more LEDs 236, or LED die packages (referred to collectively hereinafter as "LEDs"), are disposed on and/or electrically coupled to the LED board 230 and are configured to emit light. Each LED 236 includes at least one chip of semi-conductive material that is treated to create a positive-negative ("p-n") junction. When the LED or LED die package 236 is electrically coupled to a power source, such as the driver 238, current flows from the positive side to the negative side of each junction, causing charge carriers to release energy in the form of incoherent light. According to some exemplary embodiments, the LEDs 236 are aligned on the PC board 232 in a square shape array, but the array shape can be different in other exemplary embodiments.

The wavelength or color of the emitted light depends on the materials used to make the LED 236. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs 236 in the LED package can produce the same or a distinct color of light. For example, the LED package can include one or more white LED's and one or more non-white LEDs, such as red, yellow, amber, or blue LEDs, for adjusting the color temperature output of the light emitted. In certain exemplary embodiments, a yellow or multi-chromatic phosphor coats, or otherwise is used in, a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs 236 in the LED package has a color temperature between 2500 and 6000 degrees Kelvin.

In certain exemplary embodiments, an optically transmissive or clear material (not shown) encapsulates at least a portion of each LED 236. This encapsulating material provides environmental protection while transmitting light from the LEDs 236. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In some exemplary embodiments, each of the LEDs 236 emits white or substantially white light. However, one or more LEDs 236 emit non-white light in other exemplary embodiments.

Figure 3:
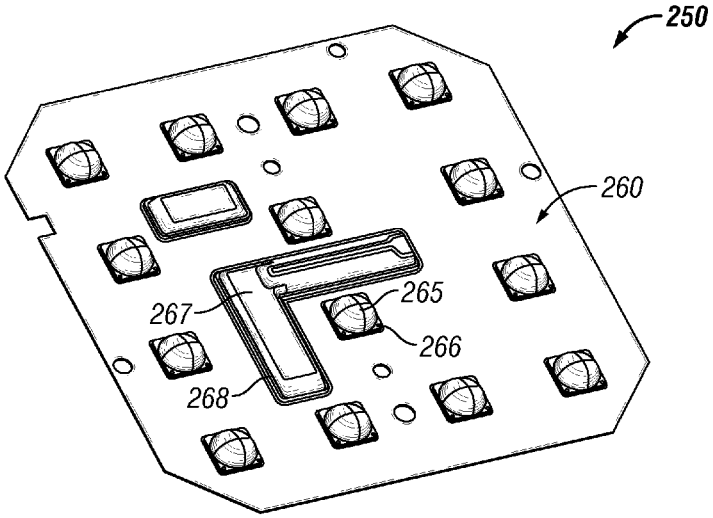
FIG. 3 is a perspective view of the optic assembly of FIG. 2A in accordance with an exemplary embodiment of the present invention.
Figure 4:
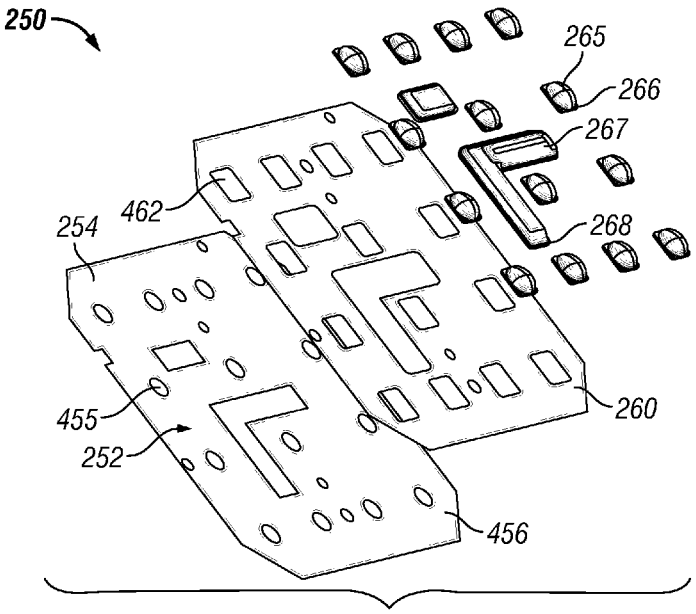
FIG. 4 is an exploded view of the optic assembly of FIG. 3 in accordance with an exemplary embodiment of the present invention.

The optic assembly 250 also is illustrated in FIGS. 3 and 4. FIG. 3 is a perspective view of the optic assembly 250 in accordance with an exemplary embodiment of the present invention. FIG. 4 is an exploded view of the optic assembly 250 in accordance with an exemplary embodiment of the present invention. Referring to FIGS. 2A-4, the optic assembly 250 includes an adhesive layer 252, a second material layer 260, one or more optics 265, and one or more caps 267.

The adhesive layer 252 includes a sandwich of layers to adhere at least a flange portion 266 of one or more optics 265 that are disposed over each LED 236 and the PC board 232. The adhesive layer 252 includes three layers; however, greater or fewer number of layers are used to form the adhesive layer 252 in other exemplary embodiments. The sandwich of layered materials includes a first material layer 254. This first material layer 254 is fabricated using a gas-permeable material according to some exemplary embodiments. According to one example, the first material layer 254 is fabricated using Tyvek®; however, other gas-permeable materials including, but not limited to, high density polyethylene, burlap, canvas, silicone, and other gas-permeable materials are used to fabricate the first material layer 254. The first material layer 254 includes several openings 455 for receiving therethrough the LED or LED die packages 236, the LED drivers 238 and any other electrical components coupled to the PC board 232. The first material layer 254 is shaped substantially similar to the PC board 232, but is shaped differently in other exemplary embodiments.

The adhesive layer 252 also includes a first adhesive material (not shown) on a bottom side 255 of the first material layer 254 and a second adhesive material (not shown) on a top side 456 of the first material layer 254. These first and second adhesive materials are fabricated using a gas-permeable material according to some exemplary embodiments. According to one example, the first and second adhesive materials are fabricated using a gas-permeable double-sided tape; however, other gas-permeable materials including, but not limited to, acrylic adhesives, silicone adhesives, and other gas-permeable adhesives are used to fabricate the first and second adhesive materials. The material used to fabricate the first adhesive material is the same material that is used to fabricate the second adhesive material. However, the first adhesive material is fabricated using a different material than used to fabricate the second adhesive material according to other exemplary embodiments. In one exemplary embodiment, at least one of the first and second adhesive materials is a viscous or semi-viscous material that is applied to the first material layer 254 and has substantially the same shape as the first material layer 254. For example, the first material layer 254 includes several openings 455 for receiving therethrough the LED or LED die packages 236, the LED drivers 238, and any other electrical components coupled to the PC board 232. Thus, the application of the viscous or semi-viscous material on the first material layer 254 to form both the first and second adhesive materials also forms matching openings (not shown) in both the first adhesive material and the second adhesive material, respectively. The openings in the first and second adhesive materials are all vertically aligned with the first material layer's openings 255. In an alternative embodiment, the first and second adhesive materials are laminated onto the bottom side 255 and the top side 456 of the first material layer 254, respectively. After the first and second adhesive materials are applied onto the first material layer 254, they are die cut to provide openings 455 in each of the first and second adhesive materials and the first material layer 254. Although some openings 455 are illustrated as being round-shaped, the openings 455 can be any geometric or non-geometric shape according to other exemplary embodiments.

The first adhesive material on the bottom side 255 of the first material layer 254 allows the first material layer 254 to adhere to the PC board 232. The second adhesive material on the top side 456 of the first material layer 254 allows multiple optics 265 and the second material layer 260, if used, to adhere to the first material layer 254. The second adhesive material provides a seal around the perimeter of each optic 265 once the optic 265 is coupled to the second adhesive material.

The second material layer 260 is disposed between the first material layer 254 and the cover plate 170 and positioned adjacently around each of the flange portion 266 of the optics 265. The second material layer 260 adheres to at least a portion of the top side 456 of the first material layer 254 via the second adhesive material. The second material layer 260 is shaped similarly to the shape of the first material layer 254 and includes several apertures 462 therein. Some of these apertures 462 are square shaped and are aligned with the round openings 455 of the first material layer 254 and the first and second adhesive materials, respectively, once the second material layer 260 is disposed over the first material layer 254. These apertures 462 in the second material layer 260 are square to clear the square perimeter of the exemplary flange portion 266 of the optic 265. However, some apertures 462 are shaped similar to the openings 455, but are slightly larger to clear the perimeter of the exemplary flange portion 268 of the caps 267. Additionally, once the second material layer 260 is disposed over the first material layer 254, a portion of the second adhesive material is exposed and accessible near the apertures 462 from the side of the second material layer 260, which allows the optics 265 and the caps 267 to be coupled to the second adhesive material. Those of ordinary skill in the art will recognize however, that the size and shape of the openings 455 in the first material layer 254 and the first and second adhesive materials and the apertures 462 in the second material layer 260 can be adjusted based on the shape of the LED or LED die package 236, the optic 265, and the caps 267 being used in the particular lighting application. The second material layer 260 is applied over the second adhesive material to prevent the collection of dust and contaminants and to add to the mechanical structure of the first and second adhesive materials and the first material layer 254. Additionally, according to some exemplary embodiments, the second material layer 260 provides additional sealing and weather proofing benefits. However, in some exemplary embodiments, these benefits are achieved by the second adhesive material without the use of the second material layer 260, thereby making the second material layer 260 optional.

The optic 265 includes the flange portion 266 and is disposed over the LED or LED die package 236. The optic 265 receives the light emitted from the LED or LED die package 236 and distributes the light to a desired illumination area. The optic 265 can be disposed over either a single LED or LED die package 236 or multiple LEDs or multiple LED die packages 236. According to some exemplary embodiments, the optic 265 is designed to receive light from the LED or LED die package 236 that the optic 265 is disposed over and direct light to the desired illumination area in a predetermined manner, which includes one or more of direction, pattern, and intensity. Each optic 265 used in the LED light module 100 is designed the same according to some exemplary embodiments, while one or more optics 265 are designed differently than another optic 265 used in the same LED light module 100 in accordance with other exemplary embodiments. The optic 265 is fabricated using an acrylic material; however, the optic 265 can be fabricated using other transparent or translucent materials, such as glass. In addition, in certain exemplary embodiments, the optic assembly 250 also includes multiple mirrors (not shown). According to some exemplary embodiments, each mirror is disposed about at least a portion of one of the LEDs or LED die packages 236 and under the optic 265. As previously mentioned above, the optic 265 is disposed over the LEDs or LED die packages 236 by placing the flange portion 266 through the second material layer's aperture 462 onto the second adhesive material, such that the flange portion 266 is disposed around the first material layer's opening 455.

Each cap 267 includes the flange portion 268 and is disposed over one or more of the driver 238, the grommet 208 and ends of the electrical wires 205, and any other electrical component coupled to the PC board 232. The caps 267 are fabricated using an acrylic material; however, one or more caps 265 can be fabricated using other suitable materials, such as glass, polymer materials, or rubber. As previously mentioned above, one or more caps 265 are disposed over the driver 238, the grommet 208 and ends of the electrical wires 205, and any other electrical component coupled to the PC board 232 by placing the flange portion 268 through the second material layer's aperture 462 onto the second adhesive material, such that the flange portion 268 is disposed around the first material layer's opening 455.

Figure 5:
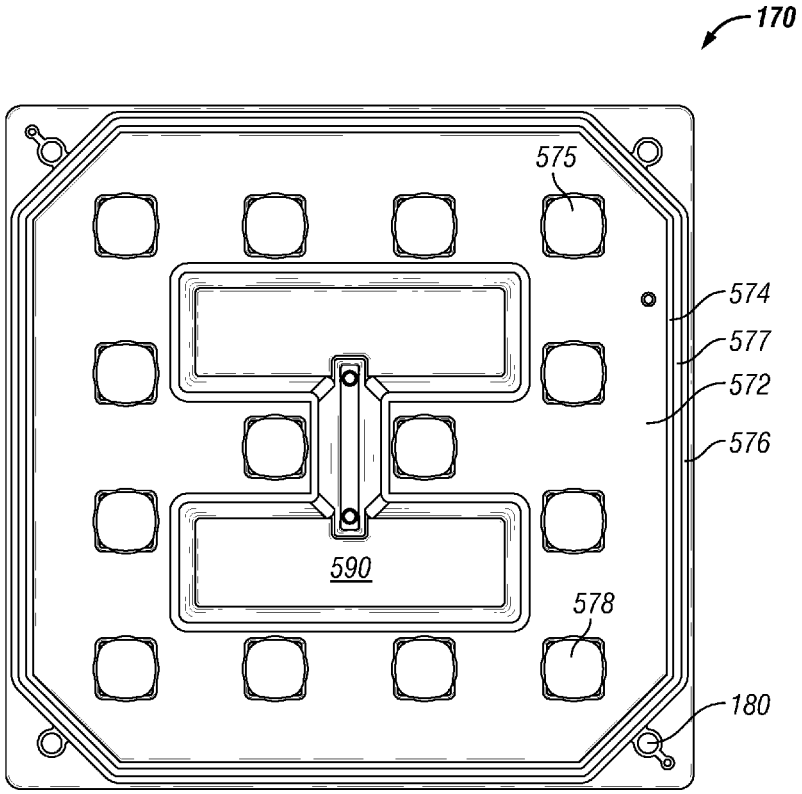
FIG. 5 is a rear view of the cover plate of FIG. 1 in accordance with an exemplary embodiment of the present invention.

The cover plate 170 also is illustrated in FIG. 5. FIG. 5 is a rear view of the cover plate 170 in accordance with an exemplary embodiment of the present invention. Referring to FIGS. 1-2B and 5, the cover plate 170 includes a first surface 172, a second surface 572, an inner wall 574 and an outer wall 576 extending orthogonally away from the second surface 572, one or more apertures 578, one or more openings 180, and one or more raised portions 174 extending outwardly from the first surface 172 and forming a cavity 590 therein which is accessible from the second surface 572. The cover plate 170 is substantially square shaped and dimensioned similarly to the dimensions of the rain shield plate 210, but can be shaped differently in other exemplary embodiments. The cover plate 170 is fabricated from die cast aluminum, but can be fabricated using other suitable materials in other exemplary embodiments.

The inner wall 574 extends orthogonally away from the second surface 572 in a substantially square shape with chamfered corners. The profile of the inner wall 574, on its interior side, is substantially similar to the profiles of the optic assembly 250 and the LED board 230 so that each of the optic assembly 250 and the LED board 230 are capable of fitting within the area formed by the inner wall 574. However, the profile of the inner wall 574 can be a different shape in other exemplary embodiments. Hence, in certain exemplary embodiments, the shape defined by the inner wall 574 and the shapes defined by the outer perimeters for the optic assembly 250 and the LED board 230 are substantially equivalent to each other.

The outer wall 576 also extends orthogonally away from the second surface 572 in a substantially square shape with chamfered corners. The profile of the outer wall 576 is substantially similar to and surrounds the profile of the inner wall 574, thereby forming a groove 577 between the inner wall 574 and the outer wall 576. However, the profile of the outer wall 576 can be a different shape in other exemplary embodiments.

One or more apertures 578 are formed within and through the cover plate 170. These apertures 578 are aligned with each optic 265 and allow for a portion of the optics 265 to extend into the apertures 575 when the cover plate 170 is disposed over the optic assembly 250. According to some exemplary embodiments, the apertures 578 allow for a portion of the optics 265 to extend beyond the first surface 172 of the cover plate 170. The apertures 578 have a substantially square shape profile that is similar to and slightly smaller than the profile of the optic's flange portion 266. However, the apertures 578 are shaped differently in other exemplary embodiments.

One or more openings 180 are formed within and through the cover plate 170 near the perimeter of the cover plate 170 and outside of the profile of the outer wall 576. In certain exemplary embodiments, the openings are formed at one or more corners of the cover plate 170. These openings 180 are aligned with the one or more apertures 217 of the base plate 212 when the LED light module 100 is assembled. These openings 180 allow a fastening device, such as a screw, to be inserted therethrough to couple the cover plate 170 to the rain shield plate 210, or bottom covering which can be the heat sink in certain exemplary embodiments.

One or more raised portions 174 extend outwardly from the first surface 172 of the cover plate 170 and form the cavity 590 therein which is accessible from the second surface 572 of the cover plate 170. These raised portions 174 are aligned with the caps 267 when the LED light module 100 is assembled. These raised portions 174 allow the caps 267 to be inserted into the cavity 590 when the cover plate 170 is disposed over the optic assembly 250.

Figure 6:
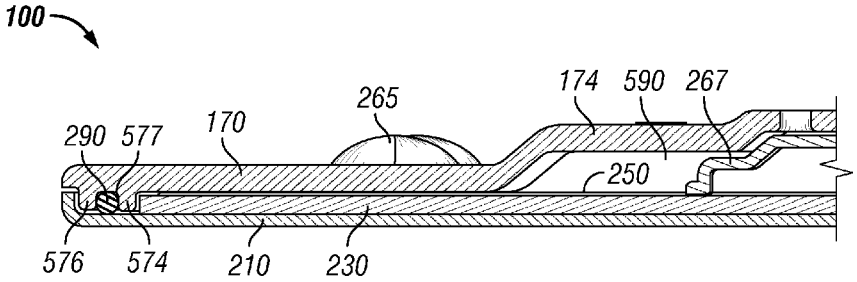
FIG. 6 is a cross-sectional view of a portion of the LED light module of FIG. 1 in accordance with an exemplary embodiment of the present invention.

The assembly of the LED light module 100 is illustrated in FIGS. 1-2B and 6. FIG. 6 is a cross-sectional view of a portion of the LED light module 100 in accordance with an exemplary embodiment of the present invention. Now referring to FIGS. 1-2B and 6, the optic assembly 250 is positioned adjacently to the cover plate 170 within the profile of the inner wall 574 such that at least a portion of each optic 265 is inserted through the corresponding aperture 578 (FIG. 5) of the cover plate 170. Also, the caps 267 are disposed within the cavity 590 formed within the raised portions 174 of the cover plate 170. Thus, the cover plate 170 is disposed over at least a portion of the flange portions 266 of each optic 265, the caps 267, and the second material layer 260, if utilized. In the embodiments where the second material layer 260 is not used, the cover plate 170 is disposed over at least a portion of the flange portions 266 of each optic 265, the caps 267, and the adhesive layer 252. The PC board 230 is positioned adjacently to the optic assembly 250 within the profile of the inner wall 574 such that each of the LEDs 236 are disposed within a respective optic 265 of the optic assembly 250 and each of the driver 238, compression grommet 208 and the opening 234, and any other electronic component coupled to the PC board 230 is disposed within one or more caps 267.

The gasket 290, which has been briefly mentioned above, is inserted into the groove 577 that is formed between the inner wall 574 and the outer wall 576. The gasket 290 is fabricated from silicone according to some exemplary embodiments, but can be fabricated using other suitable materials, such as room temperature vulcanizing (RTV) elastomer sealants, in other exemplary embodiments. The rain shield plate 210 is then coupled adjacently to the PC board 230 and is coupled to the cover plate 170 using fasteners, such as screws, inserted through each of the apertures 217 of the rain shield plate 210 and corresponding openings 180 of the cover plate 170. Once the rain shield plate 210 is coupled to the cover plate 170, the gasket 290 forms a seal therebetween within the groove 577 and protects the LEDs 236 and electrical components, such as the driver 238, housed within the inner wall 574.

Although one method for assembling the LED light module 100 has been described above, other methods can be used for assembling the LED light module 100. For example, a reverse order can be used wherein the components are sequentially placed onto the rain shield plate 210 with the cover plate 170 being eventually disposed onto the optic assembly 250. Additionally, in certain exemplary embodiments, the second surface 572 of the cover plate 170 includes a pin 299 which is inserted into an alignment hole 298 formed within each of the optic assembly 250 and the PC board 230, thereby properly aligning the optic assembly 250 and the PC board 230 onto the cover plate 170.

Figure 7A:
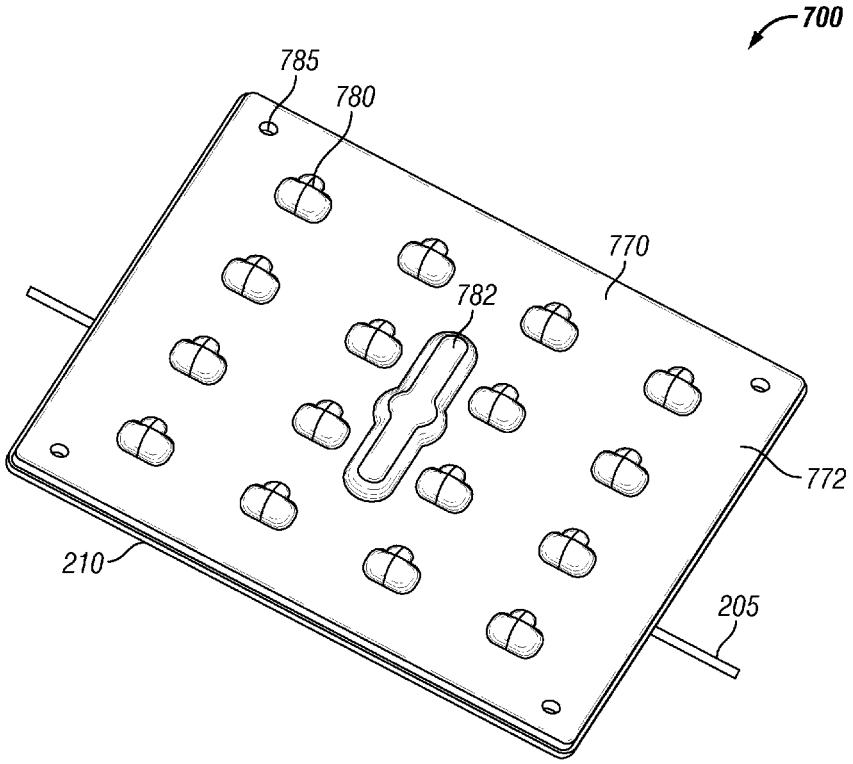
FIG. 7A is a perspective view of a light emitting diode (LED) light module in accordance with another exemplary embodiment of the present invention.
Figure 7B:
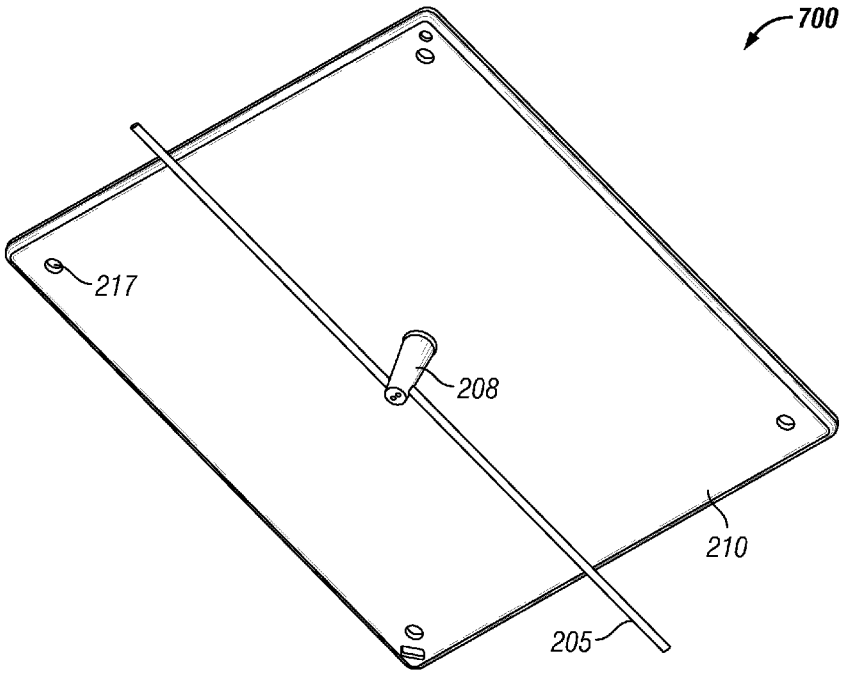
FIG. 7B is another perspective view of the LED light module of FIG. 7A in accordance with another exemplary embodiment of the present invention.
Figure 8A:
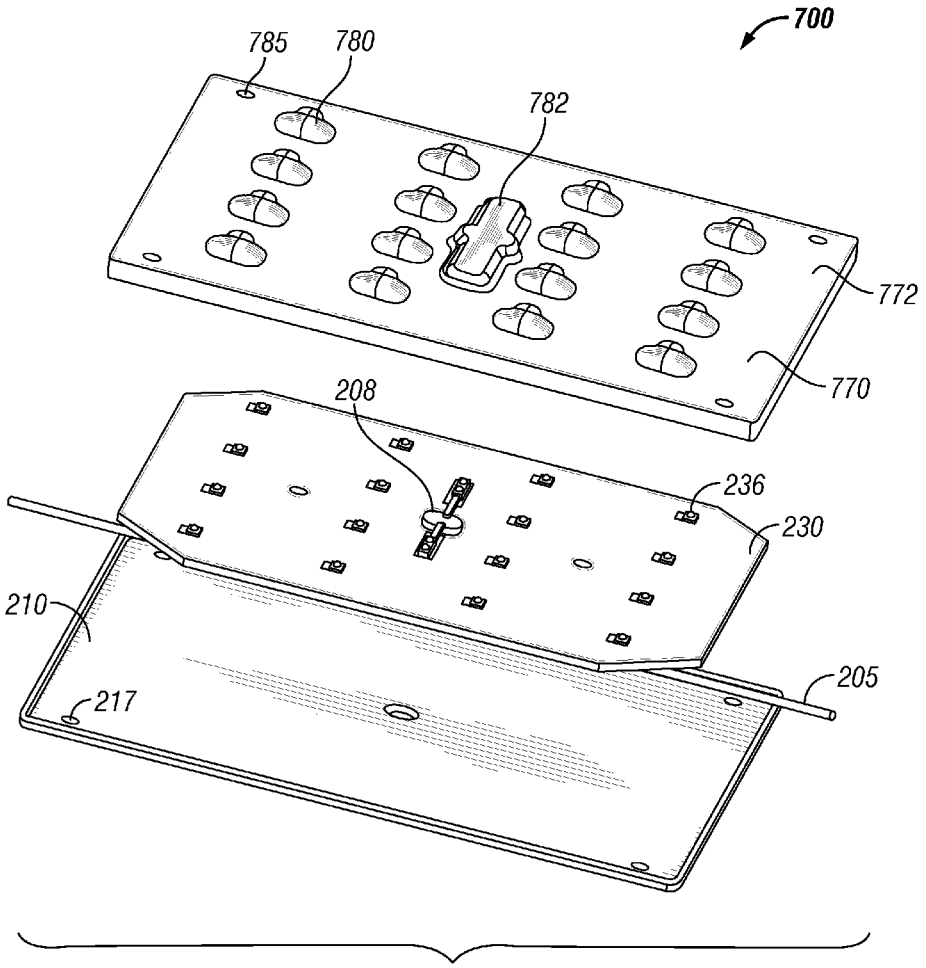
FIG. 8A is an exploded view of the LED light module of FIG. 7A in accordance with an exemplary embodiment of the present invention.
Figure 8B:
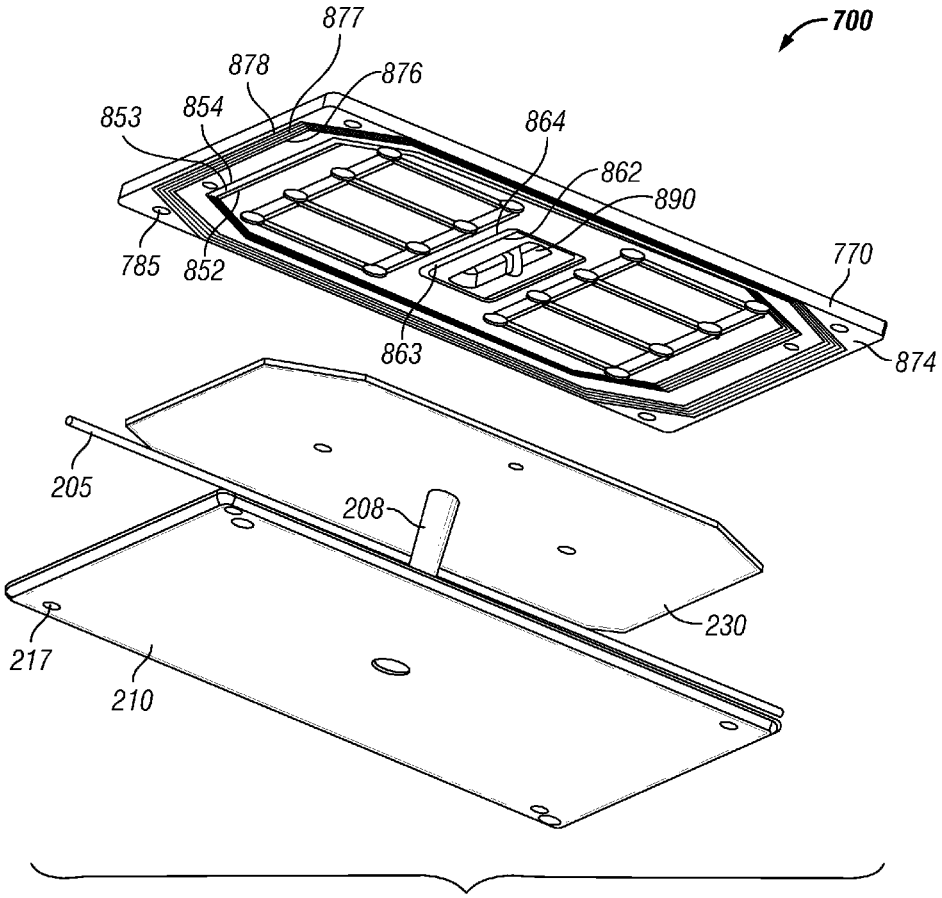
FIG. 8B is another exploded view of the LED light module of FIG. 7A in accordance with an exemplary embodiment of the present invention.

FIG. 7A is a perspective view of a light emitting diode (LED) light module 700 in accordance with another exemplary embodiment of the present invention. FIG. 7B is another perspective view of the light emitting diode (LED) light module 700 in accordance with another exemplary embodiment of the present invention. FIG. 8A is an exploded view of the LED light module 700 in accordance with an exemplary embodiment of the present invention. FIG. 8B is another exploded view of the LED light module 700 in accordance with an exemplary embodiment of the present invention. Referring to FIGS. 7A-8B, the LED light module 700 includes the rain shield plate 210, the LED board 230, a cover plate 770, and the gasket 290 (FIG. 2). The LED module 700 also includes electrical wires 205 and the compression grommet 208. In some of these exemplary embodiments, the rain shield plate 210 is fabricated as and/or functions as a heat sink. The structure, fabrication, and coupling of the rain shield plate 210, the LED board 230, the gasket 290 (FIG. 2), the electrical wires 205, and the compression grommet 208 have been described in detail above with respect to LED light module 100 (FIG. 1) and therefore are not repeated again for the sake of brevity.

The cover plate 770 combines features of cover plate 170 (FIG. 1) with features of the optic assembly 250 (FIG. 2) into a single component. The cover plate 770 includes a first surface 772, an opposing second surface 874, a first inner wall 876 and a first outer wall 878 extending orthogonally away from the second surface 874, one or more optics 780 extending out from the first surface 772, one or more openings 785, and one or more raised portions 782 extending out from the first surface 772 and forming a cavity 890 therein which is accessible from the second surface 874. In some exemplary embodiments, a second inner wall 852 and a second outer wall 854 extend orthogonally away from the second surface 874 and is positioned within the profile of the first inner wall 876 but surrounds the area that includes the optics 780. Also, in some exemplary embodiments, a third inner wall 862 and a third outer wall 864 extend orthogonally away from the second surface 874 and is positioned to surround the cavity 890 and to exclude any optics 780 within the profile of the third outer wall 864. The cover plate 770 is substantially square shaped and dimensioned similarly to the dimensions of the rain shield plate 210, but can be shaped differently in other exemplary embodiments. The cover plate 770 is fabricated from an acrylic material, but can be fabricated using other suitable materials, such as glass, that is either translucent or transparent in other exemplary embodiments. Additionally, the cover plate 770 is fabricated as a single component.

The inner wall 876 extends orthogonally away from the second surface 874 in a substantially square shape with chamfered corners. The profile of the inner wall 876, on its interior side, is substantially similar to the profile of the LED board 230 so that the LED board 230 is capable of fitting within the area formed by the inner wall 876. However, the profile of the inner wall 876 can be a different shape in other exemplary embodiments. Hence, in certain exemplary embodiments, the shape defined by the inner wall 876 and the shape defined by the outer perimeter for the LED board 230 are substantially equivalent to each other.

The outer wall 878 also extends orthogonally away from the second surface 874 in a substantially square shape with chamfered corners. The profile of the outer wall 878 is substantially similar to and surrounds the profile of the inner wall 876, thereby forming a groove 877 between the inner wall 876 and the outer wall 878. However, the profile of the outer wall 878 can be a different shape in other exemplary embodiments. The groove 877 is similar to grove 577 (FIG. 5) and allows for the gasket 290 (FIG. 2) to be disposed therein and provide a seal between the cover plate 770 and the rain shield plate 210.

One or more optics 780 are formed within the cover plate 770 and extend out from the first surface 772. These optics 780 are axially aligned with and disposed about each LED 236 coupled to the LED board 230 when the cover plate 770 is disposed over the LED board 230. The optics 780 are similar to optics 265 (FIG. 2) except that the optics 780 are formed integrally with the remaining portion of the cover plate 770 as a single component.

One or more openings 785 are formed within and through the cover plate 770 near the perimeter of the cover plate 770 and outside of the profile of the outer wall 878. In certain exemplary embodiments, the openings 785 are formed at one or more corners of the cover plate 770. These openings 785 are aligned with the one or more apertures 217 of the rain shield plate 210 when the LED light module 700 is assembled. These openings 785 allow a fastening device, such as a screw, to be inserted therethrough to couple the cover plate 770 to the rain shield plate 210, or bottom covering which can be the heat sink in certain exemplary embodiments.

One or more raised portions 782 extend outwardly from the first surface 772 of the cover plate 770 and form the cavity 890 therein which is accessible from the second surface 874 of the cover plate 770. These raised portions 782 are axially aligned about the grommet 208 and other electrical components when the LED light module 700 is assembled so that at least a portion of the grommet 208 and other electrical components are inserted into the cavity 890 when the cover plate 770 is disposed over the LED board 230.

As previously mentioned, the second inner wall 852 and the second outer wall 854 extend orthogonally away from the second surface 874 and is positioned within the profile of the first inner wall 876 but surrounds the area that includes the optics 780 according to some exemplary embodiments. In these exemplary embodiments, the second inner wall 852 and the second outer wall 854 form a second groove 853 therebetween and allows for a gasket, similar to gasket 290 (FIG. 2), to be disposed therein and provide a seal between the cover plate 770 and the LED board 230. This seal between the cover plate 770 and the LED board 230 is provided in addition to, or in lieu of, the seal between the cover plate 770 and the rain shield plate 210 depending upon the exemplary embodiment. Thus, this seal between the cover plate 770 and the LED board 230 is a redundant seal, or safety seal, in certain exemplary embodiments to ensure water, moisture, dust particles, or other contaminants do not enter an area having the LEDs 236 and other electrical components from the sides of the LED light module 700.

Also as previously mentioned, the third inner wall 862 and the third outer wall 864 extend orthogonally away from the second surface 874 and is positioned to surround the cavity 890 and to exclude any optics 780 within the profile of the third outer wall 864 according to some exemplary embodiments. In these exemplary embodiments, the third inner wall 862 and the third outer wall 864 form a third groove 863 therebetween and allows for a gasket, similar to gasket 290 (FIG. 2), to be disposed therein and provide a seal between the cover plate 770 and the LED board 230. This seal between the cover plate 770 and the LED board 230 is provided in addition to the other seals mentioned above depending upon the exemplary embodiment. Thus, this seal between the cover plate 770 and the LED board 230 is a redundant seal, or safety seal, in certain exemplary embodiments to prevent water, moisture, dust particles, or other contaminants from entering an area having the LEDs 236 and other electrical components from the cavity 890 if the grommet 208 failed.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A light module, comprising:

a cover plate comprising:

a first surface;

an opposing second surface;

an inner wall extending orthogonally out from the second surface; and an outer wall extending orthogonally out from the second surface and surrounding the inner wall, wherein the inner and outer walls define a groove formed therebetween;

a circuit board comprising a plurality of light emitting diodes (LEDs) coupled thereon, the circuit board being disposed within the profile of the inner wall, the LEDs being oriented to emit light towards the cover plate;

a gasket material disposed within the groove; and a bottom covering disposed adjacent to the circuit board and coupled to the cover plate, wherein the bottom covering comprises a first channel extending therethrough, wherein the gasket material provides a seal between the cover plate and the bottom covering, and wherein the circuit board comprises a second channel extending therethrough and vertically aligned with the first channel when the circuit board is positioned adjacent to the bottom covering, and a compression grommet coupled to at least one of the first channel and the second channel, the compression grommet allowing one or more electrical wires to be inserted therethrough and providing a seal against the respective first and second channels.

2. The light module of claim 1, wherein the cover plate further comprises one or more first openings formed therein and positioned outside the profile of the outer wall, and wherein the bottom covering comprises one or more second openings formed therein, the second openings being vertically aligned with the first openings when the bottom covering is coupled to the cover plate, the first and second openings configured to receive a coupling device to couple the bottom covering to the cover plate.

3. The light module of claim 1, wherein the cover plate and the bottom covering are substantially square and the inner wall and the circuit board are substantially square shaped with one or more chamfered corners.

4. The light module of claim 1, wherein the bottom covering is fabricated using at least one of an aluminum material, a metal alloy material, some other metal material.

5. The light module of claim 1, wherein the plurality of LEDs comprise an array of LED die packages.

6. The light module of claim 1, wherein the cover plate further comprises one or more lenses integrally formed therein, each lens being vertically aligned with at least one LEDS.

7. The light module of claim 1, wherein the circuit board further comprises a guide aperture, and wherein the cover plate further comprises a guide pin to be inserted into the guide aperture.

8. A light module, comprising:

a cover plate comprising:

a first surface;

a second opposing surface, a groove disposed in the second surface and comprising an inner wall; and at least one first opening extending through the cover plate;

an optic assembly disposed within the profile of the inner wall and comprising:

one or more second openings formed therethrough; and at least one lens coupled to the optic assembly, each lens disposed over at least one of the second openings and extending through at least a portion of the respective first opening, a circuit board comprising a plurality of light emitting diodes (LEDs) coupled thereon, the circuit board disposed within the profile of the inner wall and adjacent to the optic assembly, the LEDs being oriented to emit light into the respective lens;

a gasket material disposed within the groove; and a bottom covering being positioned adjacent to the circuit board and coupled to the cover plate through apertures disposed outside of a perimeter of the groove, wherein the gasket material provides an environmental seal between the cover plate and the bottom covering.

9. The light module of claim 8, wherein the optic assembly comprises:

an adhesive layer comprising:

a gas-permeable layer comprising one or more apertures extending therethrough;

a first adhesive material coupled to one surface of the gas-permeable layer; and a second adhesive material coupled to an opposite surface of the gas-permeable layer;

a second material layer coupled to the first adhesive material, the second material layer comprising one or more second apertures formed therethrough, the second apertures being vertically aligned with the respective first apertures and surrounding the perimeter of the respective first apertures when the second material is coupled to the adhesive layer, a portion of the adhesive layer being exposed within the perimeter of the second apertures; and at least one lens coupled to the adhesive layer, a portion of each lens being disposed on the adhesive layer through the respective second aperture.

10. The light module of claim 9, wherein the circuit board comprises a driver coupled thereon, and wherein the optic assembly further comprises one or more caps being coupled to the adhesive layer through one or more second apertures, the caps being disposed over the driver when the optic assembly is positioned adjacent to the circuit board.

11. The light module of claim 8, wherein the plurality of LEDs comprise an array of LED die packages.

12. The light module of claim 8, wherein each of the circuit board and the optic assembly further comprises a guide aperture, and wherein the cover plate further comprises a guide pin to be inserted into the guide apertures.

13. The light module of claim 8, wherein the optic assembly comprises an adhesive layer and a second material layer.

14. The light module of claim 13, wherein the adhesive layer comprises:

a gas-permeable layer;

a first adhesive material coupled to one surface of the gas-permeable layer; and a second adhesive material coupled to an opposite surface of the gas-permeable layer.

15. The light module of claim 13, wherein the circuit board comprises a driver coupled thereon, and wherein the optic assembly further comprises one or more caps being coupled to the adhesive layer through one or more second apertures, the caps being disposed over the driver when the optic assembly is positioned adjacent to the circuit board.

16. A method for assembling a light module, comprising:

providing a cover plate comprising:

a first surface;

an opposing second surface;

an inner wall extending orthogonally out from the second surface;

an outer wall extending orthogonally out from the second surface and surrounding the inner wall, the inner and outer walls defining a groove formed therebetween; and one or more first openings extending from the first surface to the second surface;

placing an optic assembly within the profile of the inner wall, the optic assembly comprising:

a top surface;

a bottom surface;

one or more second openings extending from the top surface to the bottom surface; and at least one lens coupled to the top surface and disposed over one or more of the second openings, at least a portion of each lens being inserted through at least a portion of the respective first opening;

placing a circuit board comprising a plurality of light emitting diodes (LEDs) coupled thereon adjacent to the optic assembly and within the profile of the inner wall, the LEDs being oriented to emit light into the respective lens;

placing a gasket material within the groove;

positioning a bottom covering adjacent the circuit board; and coupling the bottom covering to the cover plate, wherein the gasket material provides an environmental seal between the cover plate and the bottom covering.

17. The method of claim 16, wherein the circuit board further comprises a driver coupled thereon, and wherein the optic assembly further comprises one or more caps being coupled to the top surface and disposed over one or more of the second openings, the caps being disposed over the driver when the optic assembly is positioned adjacent to the circuit board.

18. The method of claim 16, wherein the plurality of LEDs comprise an array of LED die packages.

19. The method of claim 16, wherein each of the circuit board and the optic assembly further comprises a guide aperture formed therethrough, and wherein the cover plate further comprises a guide pin that is inserted into the guide apertures.

20. A light module, comprising:

a cover plate comprising:

an outer surface;

an inner surface;

a groove disposed in the inner surface and comprising an inner wall;

a plurality of light emitting diode (LED) apertures; and a first plurality of coupling apertures;

a bottom covering disposed adjacent to a circuit board and comprising a second plurality of coupling apertures, wherein the bottom covering comprises a first channel extending therethrough;

the circuit board comprising a surface defined by an outer perimeter and a plurality of LEDs coupled to the surface, the circuit board being disposed between the cover plate and the bottom covering and within the profile of the cover plate, the circuit board comprising a second channel extending therethrough and vertically aligned with the first channel when the circuit board is positioned adjacent to the bottom covering;

a compression grommet coupled to at least one of the first channel and the second channel, the compression grommet allowing one or more electrical wires to be inserted therethrough and providing a seal against the respective first and second channels;

a gasket material disposed in the groove, wherein the gasket material provides an environmental seal between the cover plate and the bottom covering; and a plurality of fastening devices, each fastening device extending at least partially through one of the first plurality of coupling apertures and one of the second plurality of coupling apertures to couple the bottom covering to the cover plate.

* * * * *